US012722060B1

(12) United States Patent
Hewitt

(10) Patent No.: US 12,722,060 B1
(45) Date of Patent: Sep. 1, 2026

(54) PORTABLE BATTING TRAING DEVICE THAT IS REVERSIBLY ATTACHABLE TO A FENCE

(71) Applicant: Alan Hewitt, Orangevale, CA (US)

(72) Inventor: Alan Hewitt, Orangevale, CA (US)

( * ) Notice: Subject to any disclaimer, the term of this patent is extended or adjusted under 35 U.S.C. 154(b) by 0 days.

(21) Appl. No.: 19/638,482

(22) Filed: Apr. 3, 2026

(51) Int. Cl.
*A63B 69/00* (2006.01)
*A63B 102/18* (2015.01)

(52) U.S. Cl.
CPC ..... *A63B 69/0002* (2013.01); *A63B 69/0079* (2013.01); *A63B 2069/0008* (2013.01); *A63B 2102/18* (2015.10); *A63B 2225/093* (2013.01)

(58) Field of Classification Search
CPC ..... A63B 69/0002; A63B 2069/0008; A63B 2102/18
USPC ..... 473/451
See application file for complete search history.

(56) References Cited

U.S. PATENT DOCUMENTS 708,573 A * 9/1902 Miles ..... A63B 69/30 482/89
2,772,882 A * 12/1956 Anson ..... A63B 69/0084 473/429
5,040,791 A * 8/1991 Ratajac ..... A63B 69/0084 473/426
5,271,618 A * 12/1993 Malwitz ..... A63B 69/0079 473/429
5,340,101 A * 8/1994 Lawson ..... A63B 69/0084 473/426
5,386,986 A * 2/1995 Gamboa ..... A63B 69/0079 473/430
5,458,326 A * 10/1995 Marcyes ..... A63B 69/0084 473/426
5,624,113 A * 4/1997 Rabine ..... A63B 69/0079 473/430
5,662,537 A * 9/1997 Zuber ..... A63B 69/0079 473/426
5,766,102 A * 6/1998 Lawson ..... A63B 69/0084 473/428
5,795,250 A * 8/1998 Cripe ..... A63B 69/0097 473/426
6,168,540 B1 * 1/2001 McKenna ..... A63B 69/0084 473/421
6,306,050 B1 * 10/2001 Holder ..... A63B 69/0084 473/421
7,252,603 B2 * 8/2007 Bove ..... A63B 69/0084 473/426

(Continued)

*Primary Examiner* — Joseph B Baldori
(74) *Attorney, Agent, or Firm* — Craig A. Simmermon

(57) ABSTRACT

A baseball or softball batting training device that is portable as it can be broken down into a small and neat bundle and also reversibly attachable to a fence as it may be attached to a fence for use with batting training and then removed from the fence after batting training is done. The batting training device does not require its own stand or base which allows the batting training device to be extremely portable. The batting training device includes: a collapsible frame, a left hook assembly, a right hook assembly, a net, and a ball assembly. The batting training device can be erected and locked into place with two locking pins and may be broken down by removing the two locking pins. The left hook assembly and right hook assembly are used to reversibly attach the batting training device to a fence that may be located at the ballpark.

2 Claims, 7 Drawing Sheets

(56) References Cited

U.S. PATENT DOCUMENTS

| | | | | |
|---|---|---|---|---|
| 7,704,169 | B1 * | 4/2010 | Bove | A63B 63/007 473/426 |
| 7,914,400 | B2 * | 3/2011 | Flading | A63B 71/022 473/422 |
| 9,072,954 | B2 * | 7/2015 | Riggle | A63B 69/0002 |
| 9,289,665 | B2 * | 3/2016 | Muller | A63B 71/023 |

* cited by examiner

PORTABLE BATTING TRAING DEVICE THAT IS REVERSIBLY ATTACHABLE TO A FENCE

BACKGROUND OF THE INVENTION

1. Field of the Invention

This invention relates to a baseball or softball batting training device and more specifically to a batting training device that is portable, in that it may be broken down into a small and neat bundle, and also reversibly attachable to a fence, in that it may be attached to a fence for use with batting training and then removed from the fence after batting training is done. The baseball or softball batting training device does not require its own stand or base which allows the batting training device to be even more portable.

2. Description of Related Art

There are other baseball or softball batting training devices in the prior art; however, none have the specific structure as shown and described below, which includes: a special collapsible frame that collapses down into a neat small bundle and also expands or erects into a rigid rectangle for use; two special hook assemblies that are reversibly attachable to a fence and are also collapsible; and other novel and non-obvious features as shown and described below.

BRIEF SUMMARY OF THE INVENTION

It is an aspect of portable batting training device that is reversibly attachable to a fence to include: a collapsible frame, two special hook assemblies, a net, and a ball assembly.

It is an aspect of portable batting training device that is reversibly attachable to a fence to be reversibly attachable to a fence.

It is an aspect of portable batting training device that is reversibly attachable to a fence to be portable wherein the whole device may be broken down and placed into a small carrying case for easy transport to and from the baseball or softball field.

It is an aspect of portable batting training device that is reversibly attachable to a fence to be portable wherein the whole device may be easily assembled or erected and attached to a fence for use with batting training.

It is an aspect of portable batting training device that is reversibly attachable to a fence to be usable for both left-handed batters and right handed batters.

It is an aspect of portable batting training device that is reversibly attachable to a fence to be adjustable for height.

It is an aspect of portable batting training device that is reversibly attachable to a fence to be used by a batter or player for batting training without supervision by coaches or parents.

It is an aspect of portable batting training device that is reversibly attachable to a fence to include a baseball that, went hit, rises into a net, and then falls back down again into the hitting position for another cycle.

It is an aspect of portable batting training device that is reversibly attachable to a fence to improve batters' hand eye coordination.

It is an aspect of portable batting training device that is reversibly attachable to a fence impress upon a batter the feeling and experience of proper center contact with the baseball or softball where center hits are the optimal way to hit the ball.

It is an aspect of portable batting training device that is reversibly attachable to a fence to train a person on how to hit a baseball or softball better.

DEFINITION LIST

Figure 1:
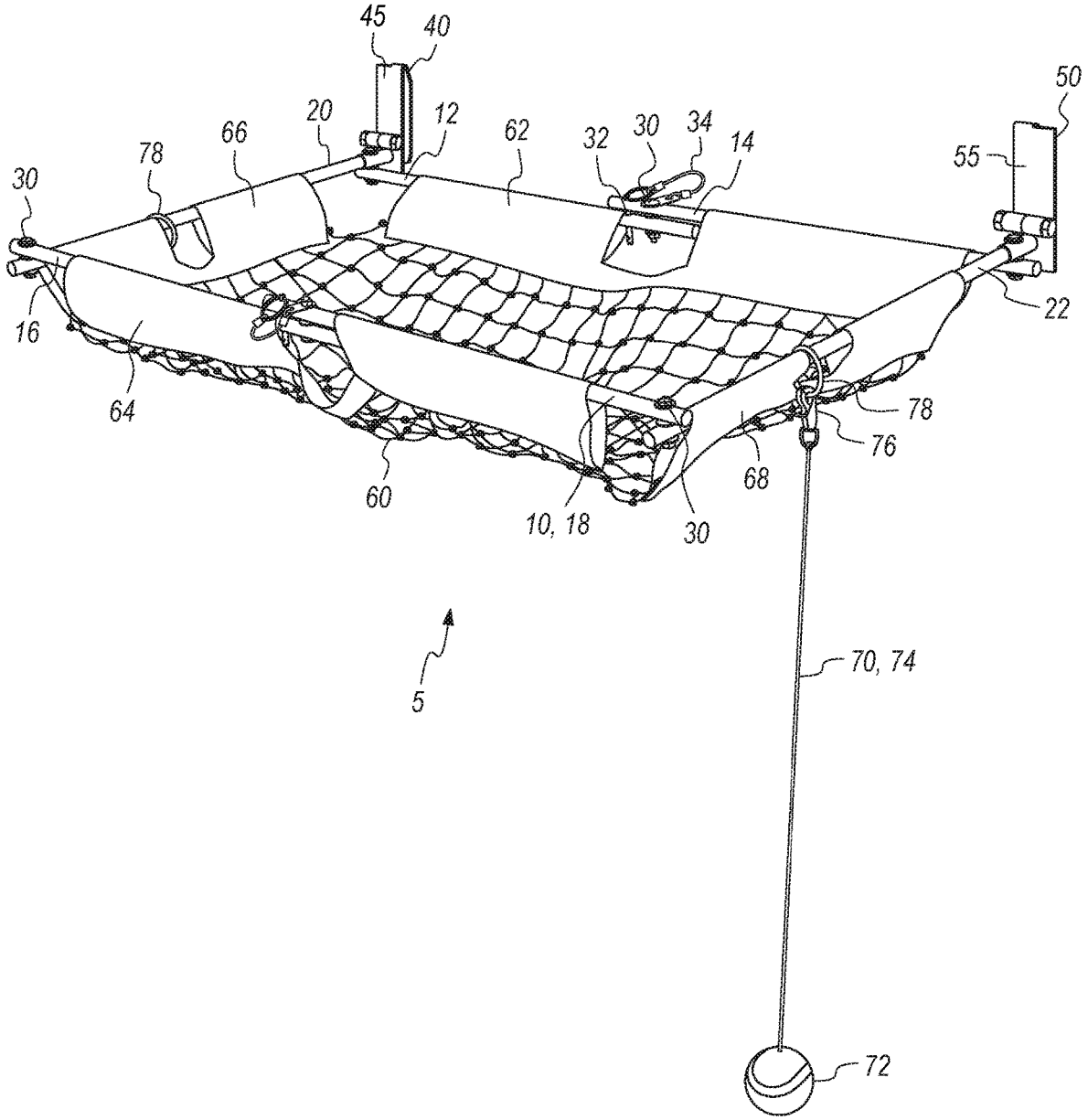
FIG. 1 is a front perspective view of portable batting training device that is reversibly attachable to a fence in the assembled or erected position.
Figure 2:
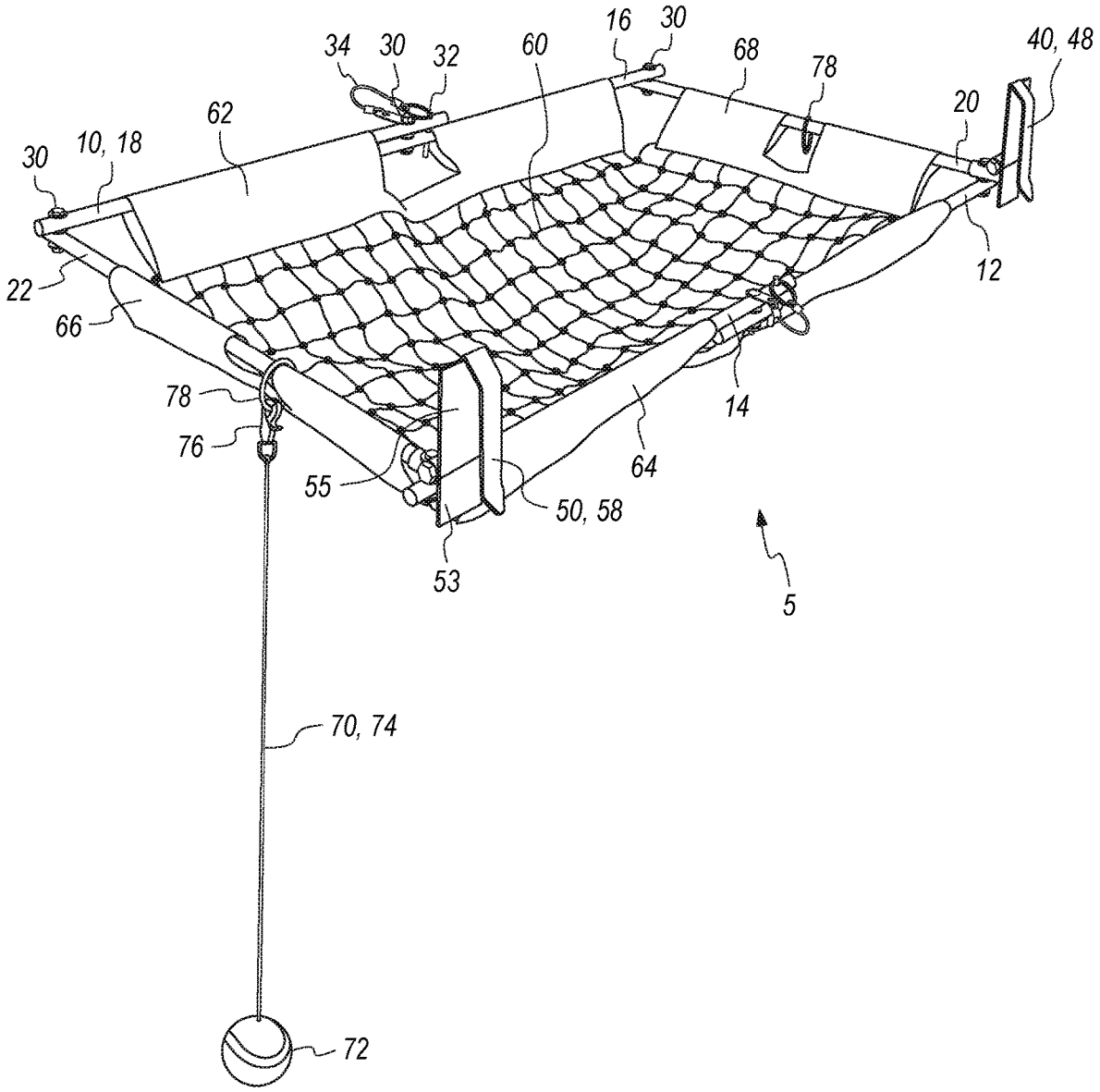
FIG. 2 is a rear perspective view of portable batting training device that is reversibly attachable to a fence in the assembled or erected position.
Figure 3:
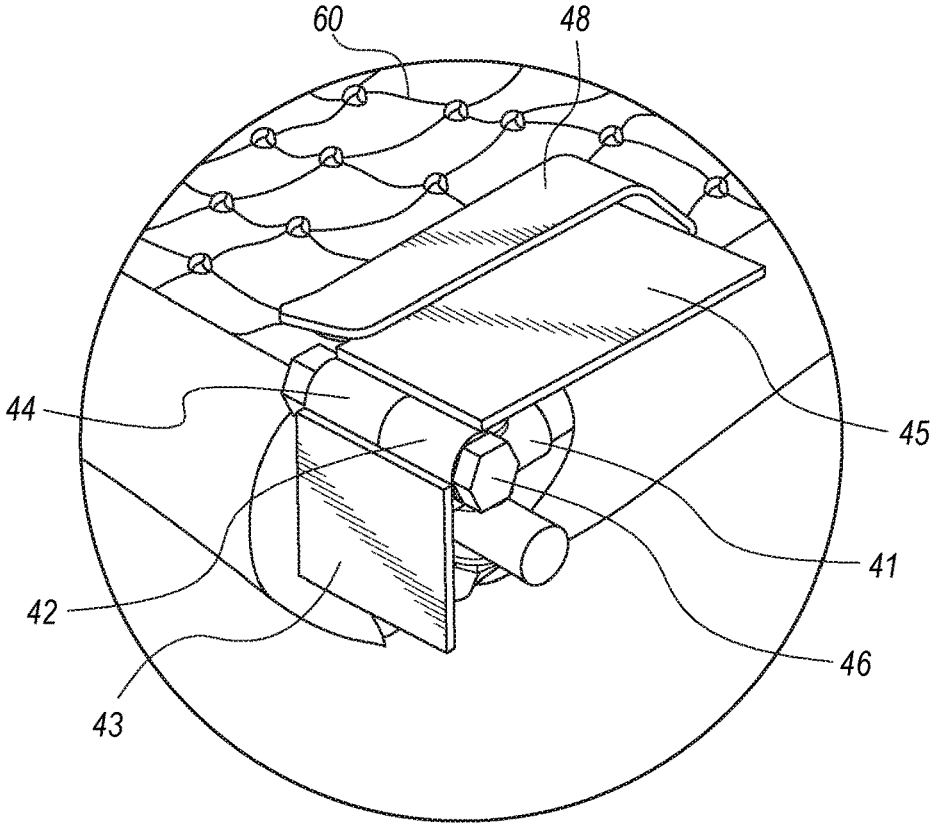
FIG. 3 is an enlarged view of the left hook assembly in the folded or broken-down position.
Figure 4:
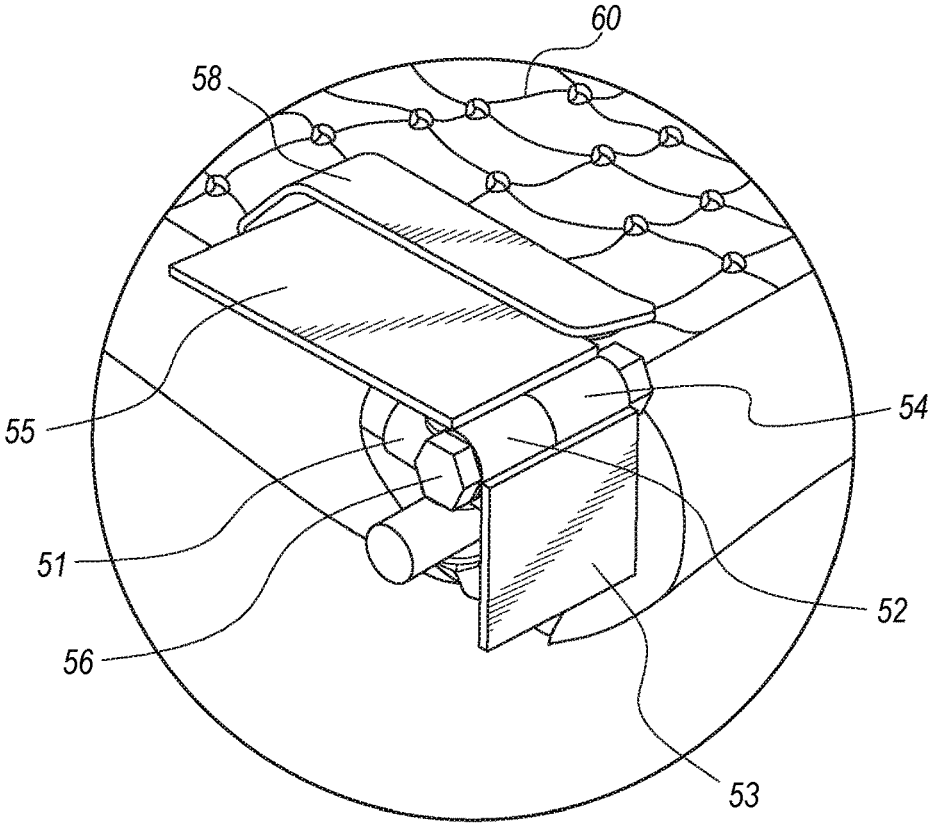
FIG. 4 is an enlarged view of the right hook assembly in the folded or broken-down position.
Figure 5:
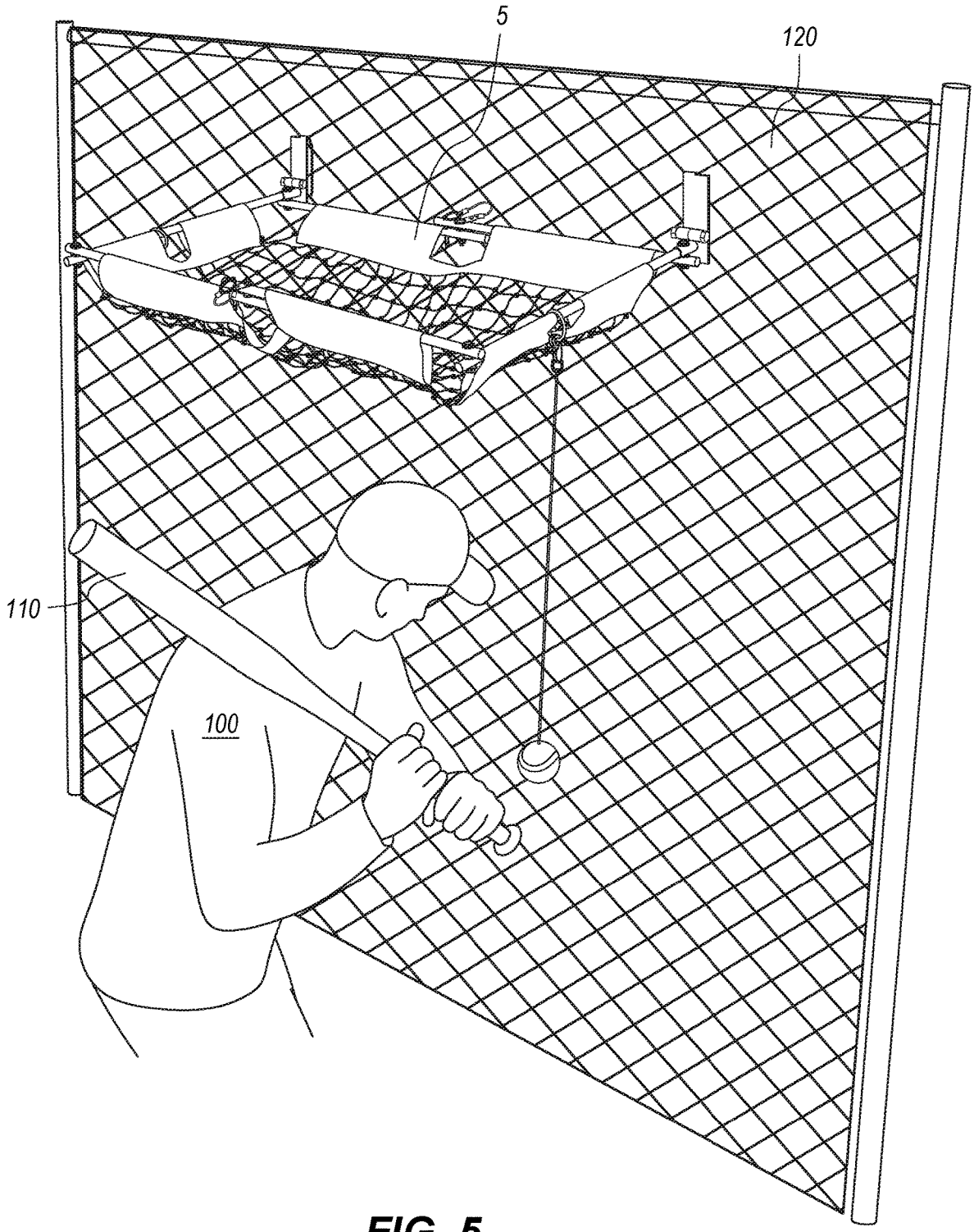
FIG. 5 is an environmental view of portable batting training device that is reversibly attachable to a fence, attached to a fence, with a batter or player getting ready to hit the baseball on the training device.
Figure 6:
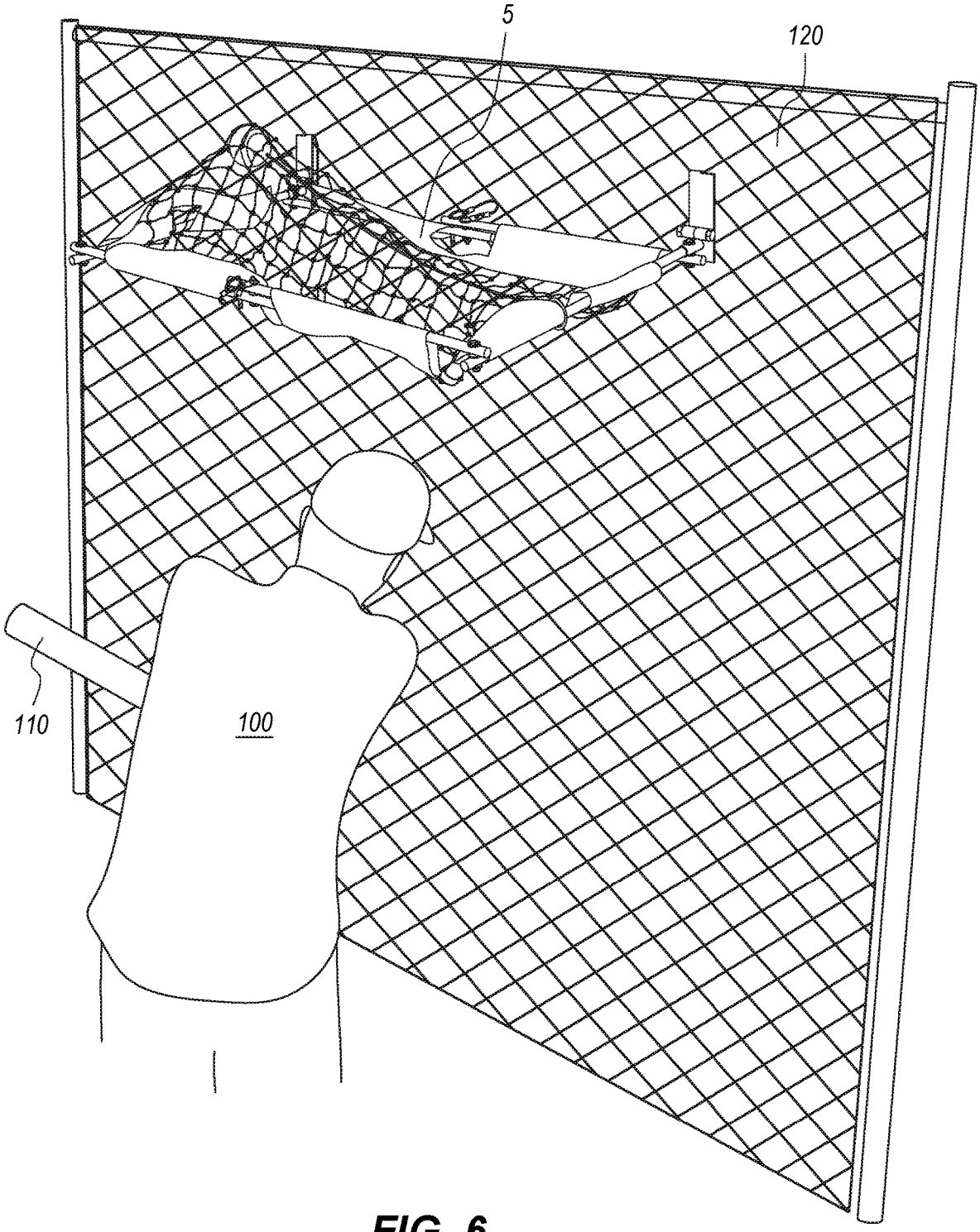
FIG. 6 is an environmental view of portable batting training device that is reversibly attachable to a fence, attached to a fence, just after a batter or player has hit the baseball on the training device.

| Term | Definition |
|---|---|
| 5 | Portable batting training device that is reversibly attachable to a fence |
| 10 | Collapsible Frame |
| 12 | First Rear Member |
| 14 | Second Rear Member |
| 16 | First Front Member |
| 18 | Second Front Member |
| 20 | Left Side Member |
| 22 | Right Side Member |
| 30 | Hinge Pin |
| 32 | Locking Pin |
| 34 | Locking Pin Leash |
| 40 | Left Hook Assembly |
| 41 | Left Sleeve Mount |
| 42 | Left First Barrel |
| 43 | Left Backer Plate |
| 44 | Left Second Barrel |
| 45 | Left Hook Plate |
| 46 | Left Hinge Pin |
| 48 | Left Hook |
| 50 | Right Hook Assembly |
| 51 | Right Sleeve Mount |
| 52 | Right First Barrel |
| 53 | Right Backer Plate |
| 54 | Right Second Barrel |
| 55 | Right Hook Plate |
| 56 | Right Hinge Pin |
| 58 | Right Hook |
| 60 | Net |
| 62 | Rear Sleeve |
| 64 | Front Sleeve |
| 66 | Left Sleeve |
| 68 | Right Sleeve |

-continued

DEFINITION LIST

| Term | Definition |
|---|---|
| 70 | Ball Assembly |
| 72 | Baseball or Softball |
| 74 | Ball Retaining Cord |
| 76 | Retaining Cord Hook |
| 78 | Ring or Connector |
| 100 | Batter or Player |
| 110 | Bat |
| 120 | Fence |

DETAILED DESCRIPTION OF THE INVENTION

Portable batting training device that is reversibly attachable to a fence 5 is a special batting training device for baseball or softball that is portable so it can be easily broken down and stored in a small carrying case (not depicted) that is easy and convenient to carry and transport to/from the baseball field or softball field. Where the portable batting training device that is reversibly attachable to a fence 5 is then easily erected and locked into the use position and then attached to a fence at the baseball field or softball field. It can be noted that every baseball and softball playing field has a fence down the left side, a fence down the right side, and a fence around the outfield. The idea is that coaches, parents, and/or players can easily transport this device 5 to the field and erect the device 5 and then attach it to a fence at the field. Players 100 may then practice their batting on this device 5 where the device 5 can be used without any supervision by coaches or parents. A player 100 can practice his or her batting by themselves and without supervision, which frees up coachs' and parents' time for other activities that benefit the whole team more rather than just one player. Multiple devices 5 can be used at any time to occupy multiple players 100. As shown and described below, a baseball or softball 72 hangs in front of the batter 100 and the batter 100 swings and hits the baseball or softball 72 which flies into a net 60 and then rebounds and falls back in front of the batter 100 again. Where the batter 100 may hit the baseball or softball 72 again, and so on. The device 5 teaches hand eye coordination that is crucial to success in batting. The device 5 also teaches proper swinging techniques. Batters 100 are able to differentiate between a solid hit on the center of the ball 72 and weaker hits that are off-center from the ball 72. Also batters 100 are able to feel exactly what it feels like when you hit a ball 72 properly in a real game because the ball 72 behaves exactly like a real ball in a real game until the ball 72 hits the net 60 which is obviously different than in a real game. However, by the time the ball 72 hits the net 60, the ball's contact with bat 110 is finished and the batter 100 has already received the proper feeling of a real hit. The device 5 can be used by both left-handed batters and right-handed batters.

Portable batting training device that is reversibly attachable to a fence 5 comprises: a collapsible frame 10; a left hook assembly 40; a right hook assembly 50; a net 60; and a ball assembly 70.

Collapsible frame 10 is a rigid framework or structure that retains and holds all other members of the device 5. Collapsible frame 10 collapses down to a neat bundle of linear members as shown and described below. Collapsible frame 10 comprises: a first rear member 12; second rear member 14; a first front member 16; a second front member 18; a left side member 20; and a right side member 22. These six members are pivotally attached together as shown and described below to form a rigid rectangular shaped frame that is collapsible and collapses down to a neat bundle of linear members that are: first rear member 12, second rear member 14, first front member 16; second front member 18; left side member 20; and right side member 22. The rectangular shape of collapsible frame 10 is about 1-4 feet wide by about 2-6 feet long.

Throughout this writing the following convention is used. "Rear" denotes the subject matter that is closest to the fence 120 on which the portable batting training device that is reversibly attachable to a fence 5 is attached. "Front" denotes the subject matter that is farthest from the fence 120 on which portable batting training device that is reversibly attachable to a fence 5 is attached. "Left" denotes the subject matter that is on the left side of a person facing the portable batting training device that is reversibly attachable to a fence 5 after it is attached to a fence 120. "Right" denotes the subject matter that is on the right side of a person facing the portable batting training device that is reversibly attachable to a fence 5 after it is attached to a fence 120.

First rear member 12, second rear member 14, first front member 16; second front member 18; left side member 20; and right side member 22 each have a set of two hinge pin holes as shown and described below. Each hinge pin hole is a circular hole that bisects the rigid cylindrical member along the diameter of the rigid cylindrical member. Each hinge pin hole has an inner diameter that is sized to make a slip fit or clearance fit with the outer diameter of each hinge pin 30 as shown and described below.

First rear member 12 is a rigid cylindrical member with: a length, an outer diameter, a left end, a right end, and a longitudinal axis. First rear member 12 has a left hinge pin hole adjacent to its left end that is located about 0.25-2 inches from its left end. First rear member 12 has a right hinge pin hole adjacent to its right end that is located about 1.5-4 inches from its right end. First rear member 12 also has a locking pin hole in between the left hinge pin hole and the right hinge pin hole, adjacent to the right hinge pin hole. Locking pin hole is a circular hole that bisects the rigid cylindrical member along the diameter of the rigid cylindrical member. This locking pin hole is located and aligned with the locking pin hole on the second rear member 14 and vice versa. Locking pin hole has an inner diameter that is sized to make a slip fit or clearance fit with the outer diameter of each locking pin 32 as shown and described below.

Second rear member 14 is a rigid cylindrical member with: a length, an outer diameter, a left end, a right end, and a longitudinal axis. Second rear member 14 has a right hinge pin hole adjacent to its right end that is located about 0.25-2 inches from its right end. Second rear member 14 has a left hinge pin hole adjacent to its left end that is located about 1.5-4 inches from its left end. Second rear member 14 also has a locking pin hole in between the left end and the left hinge pin hole. Locking pin hole is a circular hole that bisects the rigid cylindrical member along the diameter of the rigid cylindrical member. Locking pin hole has an inner diameter that is sized to make a slip fit or clearance fit with the outer diameter of each locking pin 32 as shown and described below.

First front member 16 is a rigid cylindrical member with: a length, an outer diameter, a left end, a right end, and a longitudinal axis. First front member 16 has a left hinge pin hole adjacent to its left end that is located about 0.25-2 inches from its left end. First front member 16 has a right hinge pin hole adjacent to its right end that is located about 1.5-4 inches from its right end. First front member 16 also has a locking pin hole in between the left hinge pin hole and the right hinge pin hole, adjacent to the right hinge pin hole. Locking pin hole is a circular hole that bisects the rigid cylindrical member along the diameter of the rigid cylindrical member. This locking pin hole is located and aligned with the locking pin hole on the second front member 18 and vice versa. Locking pin hole has an inner diameter that is sized to make a slip fit or clearance fit with the outer diameter of each locking pin 32 as shown and described below.

Second front member 18 is a rigid cylindrical member with: a length, an outer diameter, a left end, a right end, and a longitudinal axis. Second front member 18 has a right hinge pin hole adjacent to its right end that is located about 0.25-2 inches from its right end. Second front member 18 has a left hinge pin hole adjacent to its left end that is located about 1.5-4 inches from its left end. Second front member 18 also has a locking pin hole in between the left end and the left hinge pin hole. Locking pin hole is a circular hole that bisects the rigid cylindrical member along the diameter of the rigid cylindrical member. Locking pin hole has an inner diameter that is sized to make a slip fit or clearance fit with the outer diameter of each locking pin 32 as shown and described below.

Left side member 20 is a rigid cylindrical member with: a length, an outer diameter, a rear end, a front end, and a longitudinal axis. Left side member 20 has a rear hinge pin hole adjacent to its rear end that is located about 0.25-2 inches from its rear end. Left side member 20 has a front hinge pin hole adjacent to its front end that is located about 0.25-2 inches from its front end.

Right side member 22 is a rigid cylindrical member with: a length, an outer diameter, a rear end, a front end, and a longitudinal axis. Right side member 22 has a rear hinge pin hole adjacent to its rear end that is located about 0.25-2 inches from its rear end. Right side member 22 has a front hinge pin hole adjacent to its front end that is located about 0.25-2 inches from its front end.

First rear member 12, second rear member 14, a first front member 16, a second front member 18, a left side member 20, and right side member 22 may be made of any known material such as: metal, steel, aluminum, polymer, plastic, composite, wood, fiberglass, ceramic, carbon fiber, or any other known material.

Collapsible frame 10 further comprises: a set of six hinge pins 30. Each hinge pin 30 is a rigid cylindrical member with: a length, an outside diameter, a first end, a second, and a longitudinal axis. The outside diameter of each hinge pin 30 is sized to make a slip fit or a clearance fit with the hinge pin holes in the collapsible frame members mentioned above. The six hinge pins 30 are used to pivotally attach together all members of the collapsible frame 10, as discussed below. Despite being pivotal connections with a hinge pin 30, when all the members are erected into the rectangular shape and the lock pins 32 are installed, the erected rectangular frame is quite rigid. When the locking pins 32 are removed and the members are broken down, the erected rectangular frame collapse it into a neat bundle.

Each hinge pin 30 is a machine element that secures the position of two or more parts of a machine relative to each other. Each hinge pin 30 functions as a pin or hinge pin in the common definition of the words. Each hinge pin 30 must be very hard and tough so that it can withstand large deflection forces without bending, gulling, or failing. Typically, the second end of hinge pin 30 has a retaining head on it to prevent the hinge pin 30 from sliding through the hinge pin holes. Typically, the first end of hinge pin 30 has a retaining mechanism on it that functions to hold the hinge pin 30 into position. Hinge pin 30 may be any known type of industrial pin made out of any known type of material. In best mode, hinge pin 30 is a fastener or a threaded bolt with a retaining nut.

First rear member 12 is pivotally attached to second rear member 14 by a hinge pin 30. The right hinge pin hole on first rear member 12 is aligned with the left hinge pin hole on second rear member 14 and then a hinge pin 30 is inserted or installed into both of these hinge pin holes to be permanently installed therein. This is pivotal attachment is such that first rear member 12 may freely rotate relative to second rear member 14 around an axis that is the longitudinal axis of the hinge pin 30 inserted therein.

First front member 16 is pivotally attached to second front member 18 by a hinge pin 30. The right hinge pin hole on first front member 16 is aligned with the left hinge pin hole on second front member 18 and then a hinge pin 30 is inserted or installed into both of these hinge pin holes to be permanently installed therein. This is pivotal attachment is such that first front member 16 may freely rotate relative to second front member 18 around an axis that is the longitudinal axis of the hinge pin 30 inserted therein.

First rear member 12 is pivotally attached to left side member 20 by a hinge pin 30 as follows. The rear end of left side member 20 is first inserted into left sleeve mount 41. As discussed below, the left sleeve mount 41 is rigidly attached to left backer plate 43. Then, the left hinge pin hole on first rear member 12 is aligned with the rear hinge pin hole on left side member 20. Then, the hinge pin 30 is inserted or installed through the hinge pin hole of left side member 20, the hinge pin hole of left sleeve mount 41, and the hinge pin hole of the first rear member 12, as depicted. This is pivotal attachment is such that first rear member 12 may freely rotate relative to left side member 20 around an axis that is the longitudinal axis of the inserted hinge pin 30 inserted therein.

Second rear member 14 is pivotally attached to right side member 22 by a hinge pin 30 as follows. The rear end of right side member 22 is first inserted into right sleeve mount 51. As discussed below, the right sleeve mount 51 is rigidly attached to right backer plate 53. Then, the right hinge pin hole on second rear member 14 is aligned with the rear hinge pin hole on right side member 22. Then, the hinge pin 30 is inserted or installed through the hinge pin hole of right side member 22, the hinge pin hole of right sleeve mount 51, and the hinge pin hole of the second rear member 14, as depicted. This is pivotal attachment is such that second rear member 14 may freely rotate relative to right side member 22 around an axis that is the longitudinal axis of the inserted hinge pin 30 inserted therein.

First front member 16 is pivotally attached to left side member 20 by a hinge pin 30. The left hinge pin hole on first front member 16 is aligned with the front hinge pin hole on left side member 20 and then a hinge pin 30 is inserted or installed into both of these hinge pin holes to be permanently installed therein. This is pivotal attachment is such that first front member 16 may freely rotate relative to left side member 20 around an axis that is the longitudinal axis of the inserted hinge pin 30 inserted therein.

Second front member 18 is pivotally attached to right side member 22 by a hinge pin 30. The right hinge pin hole on second front member 18 is aligned with the front hinge pin hole on right side member 22 and then a hinge pin 30 is inserted or installed into both of these hinge pin holes to be permanently installed therein. This is pivotal attachment is such that second front member 18 may freely rotate relative to right side member 22 around an axis that is the longitudinal axis of the inserted hinge pin 30 inserted therein.

Figure 7:
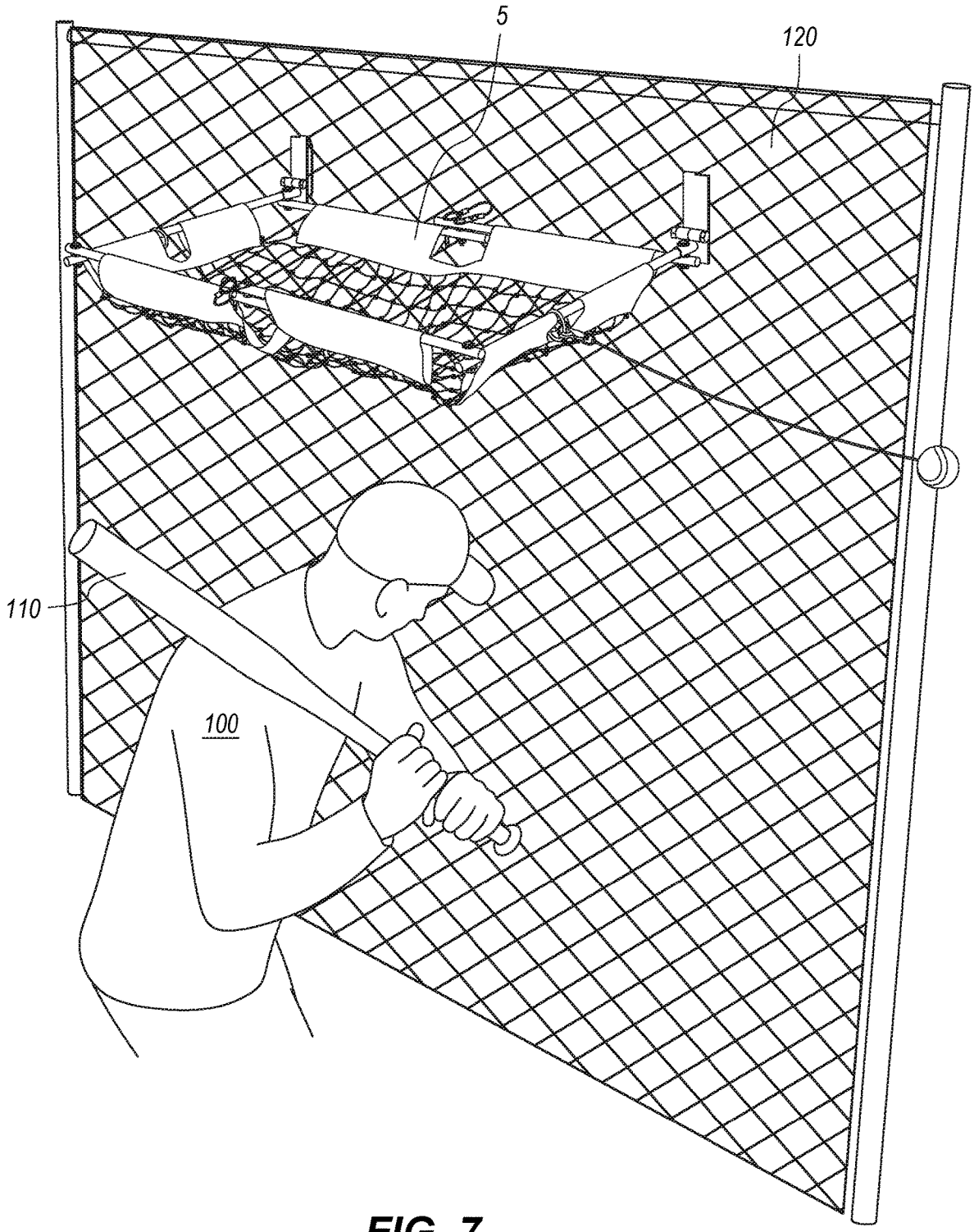
FIG. 7 is an environmental view of portable batting training device that is reversibly attachable to a fence, attached to a fence, a few seconds after a batter or player has hit the baseball on the training device.
Figure 8:
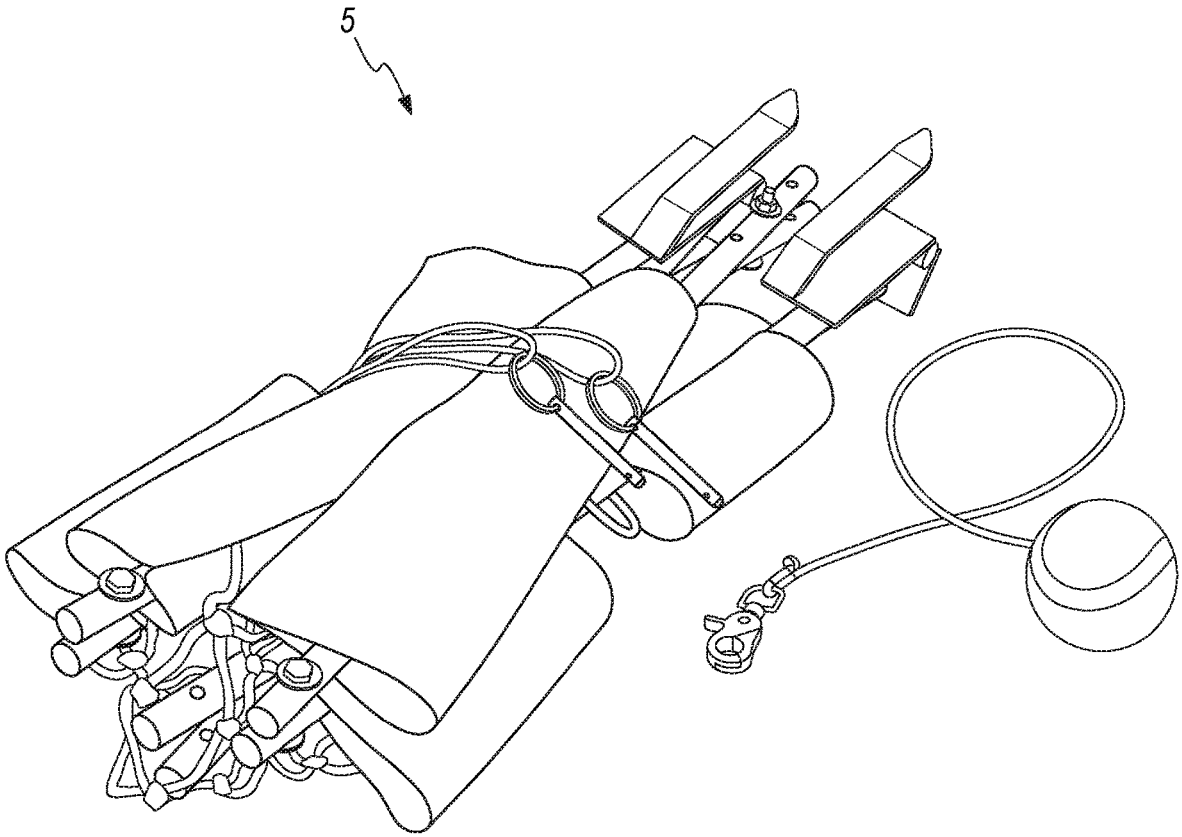
FIG. 8 is a perspective view of portable batting training device that is reversibly attachable to a fence in the broken-down position, without being placed into a carrying case.

The above six pivotal attachment points allow the collapsible frame 10 to expand and erect into a rigid rectangular shape for use of the batting training device 5 as depicted in FIG. 1 and also allow the collapsible frame 10 to collapse down into a neat and small bundle as depicted in FIG. 7. Even though these members are connected with hinge pins 30, once the collapsible frame 10 is erected and the two locking pins 32 are inserted, as discussed below, the collapsible frame 10 becomes very strong and rigid for sturdy use of the device 5.

Collapsible frame 10 further comprises: a set of two locking pins 32. Each locking pin 32 is a rigid cylindrical member with: a length, an outside diameter, a first end, a second, and a longitudinal axis. The outside diameter of each locking pin 32 is sized to make a slip fit or a clearance fit with the locking pin holes in the collapsible frame members mentioned above. Each locking pin 32 is used to lock together members of the collapsible frame 10. Each locking pin 32 is a machine element that secures the position of two or more parts of a machine relative to each other. Each locking pin 32 functions as a locking pin or retaining pin in the common definition of the words. Each locking pin 32 must be very hard and tough so that it can withstand large deflection forces without bending, gulling, or failing. Typically, the second end of locking pin 32 has a retaining head on it to prevent the locking pin 32 from sliding through the locking pin holes. Typically, the first end of locking pin 32 has a retaining mechanism on it that functions to hold the locking pin 32 within the locking pin holes position. Locking pin 32 may be any known type of industrial pin made out of any known type of material. In best mode, locking pin 32 is has a retaining leash 34 that is a length of strong cordage with a first end attached to the locking pin 32 and a second end attached to an installed hinge pin 30, as depicted. The leash 34 functions to retain the locking pin 32 or keep the locking pin 32 from getting lost when the locking pin 32 is removed from the locking pin holes and the collapsible frame 10 is in the collapsed position.

The two locking pins 32 are used to retain or lock the collapsible frame 10 in the rectangular shape that is required for use of the device 5. When the collapsible frame 10 is expanded into the proper rectangular shape for use, the locking pin hole on the first rear member 12 aligns with the locking pin hole on the second rear member 14, so that a locking pin 32 may be inserted into both locking pin holes in order to retain or lock the first rear member 12 and second rear member 14 into this position. Likewise, when the collapsible frame 10 is expanded into the proper rectangular shape for use, the locking pin hole on the first front member 16 aligns with the locking pin hole on the second front member 18, so that a locking pin 32 may be inserted into these locking pin holes in order to retain or lock the first front member 16 and second front member 18 into this position.

Net 60 is an assembly of threads, cords, straps, or yarns knotted and twisted into a grid-like structure which blocks the passage of large items, while letting small items and fluids pass, which requires less material than something sheet-like, and provides a degree of transparency, as well as flexibility and lightness. Net 60 is a net or netting in the common definition of the words. The grid-like structure of net 60 has a spacing of about 0.25-2 inches wherein this spacing must be small enough to prevent a baseball or softball 72 from passing through the grid. Net 60 must be made from high-strength material or cordage to prevent a baseball or softball 72 from breaking through the grid. Net 60 is a rectangular shaped section of netting with: a width, a length, a thickness, a rear edge, a front edge, a left edge, and a right edge. The length and width of net 60 are sized to fit the rectangular shape of the erected collapsible frame 10.

Net 60 further comprises: a rear sleeve 62; front sleeve 64; left sleeve 66; and a right sleeve 68.

Rear sleeve 62 is a tubular segment of strong tear-resistant fabric. Rear sleeve 62 has: a length, an inner diameter, an outer diameter, a rear side, a front side, a center, a left end, and a right end. Rear sleeve 62 functions to attach the rear edge of net 60 to the first rear member 12 and second rear member 14 of collapsible frame 10. The rear edge of net 60 is sewn to or otherwise permanently attached to the front side of rear sleeve 62. Rear sleeve 62 has a center gap that is a void or notch cut out of the tubular segment of fabric in the center of the tube, as depicted. Center gap is clearance space for the hinge pin 30 and the locking pin 32 that are connecting the first rear member 12 to the second rear member 14. This clearance space is necessary for the proper assembly of the device 5 and also to allow for the collapsibility of the device 5. The first rear member 12 is inserted into the rear sleeve 62, into the center of the tubular segment of fabric, on the left of the center gap, during assembly of the device 5, as depicted. The second rear member 14 is inserted into the rear sleeve 62, into the center of the tubular segment of fabric, on the right of the center gap, during assembly of the device 5, as depicted. The first rear member 12 and second rear member 14 then live inside the rear sleeve 62 throughout the life of the device 5. Thus, rear sleeve 62 connects the net 60 to first rear member 12 and second rear member 14 because these members lie inside of the rear sleeve 62.

Front sleeve 64 is a tubular segment of strong tear-resistant fabric. Front sleeve 64 has: a length, an inner diameter, an outer diameter, a rear side, a front side, a center, a left end, and a right end. Front sleeve 64 functions to attach the front edge of net 60 to the first front member 16 and second front member 18 of collapsible frame 10. The front edge of net 60 is sewn to or otherwise permanently attached to the rear side of front sleeve 64. Front sleeve 64 has a center gap that is a void or notch cut out of the tubular segment of fabric in the center of the tube, as depicted. Center gap is clearance space for the hinge pin 30 and the locking pin 32 that are connecting the first front member 16 to the second front member 18. This clearance space is necessary for the proper assembly of the device 5 and also to allow for the collapsibility of the device 5. The first front member 16 is inserted into the front sleeve 64, into the center of the tubular segment of fabric, on the left of the center gap, during assembly of the device 5, as depicted. The second front member 18 is inserted into the front sleeve 64, into the center of the tubular segment of fabric, on the right of the center gap, during assembly of the device 5, as depicted. The first front member 16 and second front member 18 then live inside the front sleeve 64 throughout the life of the device 5. Thus, front sleeve 64 connects the net 60 to first front member 16 and second front member 18 because these members lie inside of the front sleeve 64.

Left sleeve 66 is a tubular segment of strong tear-resistant fabric. Left sleeve 66 has: a length, an inner diameter, an outer diameter, a rear side, a front side, a center, a left end, and a right end. Left sleeve 66 functions to attach the left edge of net 60 to the left side member 20 of collapsible frame 10. The left edge of net 60 is sewn to or otherwise permanently attached to the right side of left sleeve 66. Left sleeve 66 has a center gap that is a void or notch cut out of the tubular segment of fabric in the center of the tube, as depicted. Center gap is clearance space for the ball assembly 70 that would be attached in the center gap for left-handed batters 100. The left side member 20 is inserted into the left sleeve 66, into the center of the tubular segment of fabric, during assembly of the device 5, as depicted. The left side member 20 then lives inside the left sleeve 66 throughout the life of the device 5. Thus, left sleeve 66 connects the net 60 to left side member 20 because this member lies inside of the left sleeve 66.

Right sleeve 68 is a tubular segment of strong tear-resistant fabric. Right sleeve 68 has: a length, an inner diameter, an outer diameter, a rear side, a front side, a center, a left end, and a right end. Right sleeve 68 functions to attach the right edge of net 60 to the right side member 22 of collapsible frame 10. The right edge of net 60 is sewn to or otherwise permanently attached to the left side of right sleeve 68. Right sleeve 68 has a center gap that is a void or notch cut out of the tubular segment of fabric in the center of the tube, as depicted. Center gap is clearance space for the ball assembly 70 that would be attached in the center gap for right-handed batters 100. The right side member 22 is inserted into the right sleeve 68, into the center of the tubular segment of fabric, during assembly of the device 5, as depicted. The right side member 22 then lives inside the right sleeve 68 throughout the life of the device 5. Thus, right sleeve 68 connects the net 60 to right side member 22 because this member lies inside of the right sleeve 68.

Left hook assembly 40 comprises: a left sleeve mount 41; a left first barrel 42; a left backer plate 43; a left second barrel 44; a left hook plate 45; a left hinge pin 46; and a left hook 48. Left sleeve mount 41 is a rigid hollow cylindrical member with open ends. Left sleeve mount 41 has: a rear end, a front end, an inner diameter, an outer diameter, an outer surface, an inner surface, a length, and a longitudinal axis. Left first barrel 42 is a rigid hollow cylindrical member with open ends. Left first barrel 42 has: an inner diameter, an outer diameter, an outer surface, an inner surface, a length, and a longitudinal axis. Left backer plate 43 is a rigid planar member. In best mode, a rectangular or square member. Left backer plate 43 has: a length, a width, a thickness, a rear surface, a front surface, an upper edge, a lower edge, a left edge, a right edge, and a plane. Left second barrel 44 is a rigid hollow cylindrical member with open ends. Left second barrel 44 has: an inner diameter, an outer diameter, an outer surface, an inner surface, a length, and a longitudinal axis. Left second barrel 44 is identical to left first barrel 42. Left hook plate 45 is a rigid planar member. In best mode, a rectangular member. Left hook plate 45 has: a length, a width, a thickness, a rear surface, a front surface, an upper edge, a lower edge, a left edge, a right edge, a plane, latitudinal axis, and a longitudinal axis. Left hinge pin 46 is a rigid cylindrical member with: a length, an outside diameter, a first end, a second, and a longitudinal axis. Left hinge pin 46 is a machine element that secures the position of two or more parts of a machine relative to each other. Left hinge pin 46 functions as a pin or hinge pin in the common definition of the words. Left hinge pin 46 must be very hard and tough so that it can withstand large deflection forces without bending, gulling, or failing. The outside diameter of left hinge pin 46 is sized to make a slip fit or a clearance fit with the inside diameter of left first barrel 42 and left second barrel 44. Left hinge pin 46 is used to pivotally attach left hook plate 45 to left backer plate 43, via left first barrel 42 and left second barrel 44, as discussed below. Typically, the second end of left hinge pin 46 has a retaining head on it to prevent it from sliding through the barrels on the hinge. Typically, the first end of left hinge pin 46 has a retaining mechanism on it that functions to hold the left hinge pin 46 within the barrels. Left hinge pin 46 may be any known type of industrial pin made out of any known type of material. In best mode, left hinge pin 46 is a fastener or a threaded bolt with a retaining nut. Left hook 48 is a piece of material that is curved or bent back at an angle, for catching hold of or hanging things on. Left hook 48 has: an upper angled portion, a straight portion, and a lower flared portion. The upper side of the upper angled portion is rigidly attached to or integral with the upper side of the straight portion. The lower side of the straight portion is rigidly attached to or integral with the upper side of lower flared portion. Each portion has: a length, a width, a thickness, and a longitudinal axis. These elements form a hook in the common definition of the word. The longitudinal axis of the lower flared portion forms a 35-55 degree angle with the longitudinal axis of the straight portion. The longitudinal axis of the upper angled portion forms a 35-55 degree angle with the longitudinal axis of the straight portion. The length of the straight portion is twice as much or more of the length of the upper angled portion. The length of the straight portion is twice as much or more as the length of the lowered flare portion. The upper side of upper angled portion of left hook 48 is rigidly attached to or integral with the upper edge of left backer plate 43. Left sleeve mount 41 has a hinge pin hole through its diameter that is a circular hole completely through the sleeve with clearance space for a hinge pin 30. Left sleeve mount 41 is rigidly attached to left backer plate 43. The inner diameter of left sleeve mount 41 is sized to make a slip fit or clearance fit with the outer diameter of left side member 20. The rear end of left sleeve mount 41 is rigidly attached to the front surface of left backer plate 43 so that the longitudinal axis of left sleeve mount 41 is perpendicular to the plane of left backer plate 43. Left sleeve mount 41 functions as a fixture or bracket to retain left side member 20. During assembly, the rear end of left side member 20 is inserted into the front end of left sleeve mount 41, so that the rear end of left side member 20 slides all the way into the left sleeve mount 41 to bottom out onto the outer surface of left backer plate 43. Left side member 20 then lives in this location for the life of the product. As discussed above, a hinge pin 30 is used to lock it in this location.

The front surface or upper edge of left backer plate 43 is rigidly attached to the outer surface of left first barrel 42 so that the upper edge of left backer plate 43 is parallel with the longitudinal axis of left first barrel 42. The outer surface of left first barrel 42 is rigidly attached to left backer plate 43. The front surface or lower edge of left hook plate 45 is rigidly attached to the outer surface of left second barrel 44 so that the lower edge of left hook plate 45 is parallel with the longitudinal axis of left second barrel 44. The rear surface or upper edge of left hook plate 45 is rigidly attached to or integral with the upper angled portion of left hook 48 so that the longitudinal axis of the straight portion of left hook 48 is parallel with the longitudinal axis of left hook plate 45, as depicted. Alternately, left first barrel 42 and left second barrel 44 maybe alternated or swapped from as described above, so that the left first barrel 42 is rigidly attached to or integral with left hook plate 45 and left second barrel 44 is rigidly attached to or integral with left backer plate 43. It does not matter which barrel is attached to which plate, because the plates 43,45 will still be pivotally connected by left hinge pin 46.

Left hook 48 functions as a hook that attaches to a fence 120 by sliding the left hook 48 into an aperture on the fence or a horizontal member on the fence, as a wire. Gravity then holds the hook 48 and the device 5 onto the aperture or horizontal member of the fence. To remove left hook 48 and the device 5 from the fence, left hook 48 is simply lifted up to lift the left hook 48 up and out from the aperture or off of the horizontal member of the fence. Left hook 48 is designed to easily slide into an aperture of a chain-link fence because most baseball fields and softball fields use chain-link fences that run around the baseball or softball field. Thus, this invention 5 is very convenient and easy to bring to a baseball or softball field and set up on the field for use by the players 100.

Right hook assembly 50 comprises: a right sleeve mount 51; a right first barrel 52; a right backer plate 53; a right second barrel 54; a right hook plate 55; a right hinge pin 56; and a right hook 58. Right sleeve mount 51 is a rigid hollow cylindrical member with open ends. Right sleeve mount 51 has: a rear end, a front end, an inner diameter, an outer diameter, an outer surface, an inner surface, a length, and a longitudinal axis. Right first barrel 52 is a rigid hollow cylindrical member with open ends. Right first barrel 52 has: an inner diameter, an outer diameter, an outer surface, an inner surface, a length, and a longitudinal axis. Right backer plate 53 is a rigid planar member. In best mode, a rigid rectangular or square member. Right backer plate 53 has: a length, a width, a thickness, a rear surface, a front surface, an upper edge, a lower edge, a left edge, and a right edge. Right second barrel 54 is a rigid hollow cylindrical member with open ends. Right second barrel 54 has: an inner diameter, an outer diameter, an outer surface, an inner surface, a length, and a longitudinal axis. Right second barrel 54 is identical to right first barrel 52. Right hook plate 55 is a rigid planar member. In best mode, a rectangular or square member. Right hook plate 55 has: a length, a width, a thickness, a rear surface, a front surface, an upper edge, a lower edge, a left edge, a right edge, and a longitudinal axis. Right hinge pin 56 is a rigid cylindrical member with: a length, an outside diameter, a first end, a second, and a longitudinal axis. Right hinge pin 56 is a machine element that secures the position of two or more parts of a machine relative to each other. Right hinge pin 56 functions as a pin or hinge pin in the common definition of the words. Right hinge pin 56 must be very hard and tough so that it can withstand large deflection forces without bending, gulling, or failing. The outside diameter of right hinge pin 56 is sized to make a slip fit or a clearance fit with the inside diameter of right first barrel 52 and right second barrel 54. Right hinge pin 56 is used to pivotally attach right hook plate 55 to right backer plate 53, via right first barrel 52 and right second barrel 54, as discussed below. Typically, the second end of right hinge pin 56 has a retaining head on it to prevent it from sliding through the barrels on the hinge. Typically, the first end of right hinge pin 56 has a retaining mechanism on it that functions to hold the right hinge pin 56 within the barrels. Right hinge pin 56 may be any known type of industrial pin made out of any known type of material. In best mode, right hinge pin 56 is a fastener or a threaded bolt with a retaining nut. Right hook 58 is a piece of material that is curved or bent back at an angle, for catching hold of or hanging things on. Right hook 58 has: an upper angled portion, a straight portion, and a lower flared portion. The upper side of the upper angled portion is rigidly attached to or integral with the upper side of the straight portion. The lower side of the straight portion is rigidly attached to or integral with the upper side of lower flared portion. Each portion has: a length, a width, a thickness, and a longitudinal axis. These elements form a hook in the common definition of the word. The longitudinal axis of the lower flared portion forms a 35-55 degree angle with the longitudinal axis of the straight portion. The longitudinal axis of the upper angled portion forms a 35-55 degree angle with the longitudinal axis of the straight portion. The length of the straight portion is twice as much or more of the length of the upper angled portion. The length of the straight portion is twice as much or more as the length of the lowered flare portion. The upper side of upper angled portion of right hook 58 is rigidly attached to or integral with the upper edge of right backer plate 53. Right sleeve mount 51 has a hinge pin hole through its diameter that is a circular hole completely through the sleeve with clearance space for a hinge pin 30. Right sleeve mount 51 is rigidly attached to right backer plate 53. The inner diameter of right sleeve mount 51 is sized to make a slip fit or clearance fit with the outer diameter of right side member 22. The rear end of right sleeve mount 51 is rigidly attached to the front surface of right backer plate 53 so that the longitudinal axis of right sleeve mount 51 is perpendicular to the plane of right backer plate 53. Right sleeve mount 51 functions as a fixture or bracket to retain right side member 22. During assembly, the rear end of right side member 22 is inserted into the front end of right sleeve mount 51, so that the rear end of right side member 22 slides all the way into the right sleeve mount 51 to bottom out onto the outer surface of right backer plate 53. Right side member 22 then lives in this location for the life of the product. As discussed above, a hinge pin 30 is used to lock it in this location.

The front surface or upper edge of right backer plate 53 is rigidly attached to the outer surface of right first barrel 52 so that the upper edge of right backer plate 53 is parallel with the longitudinal axis of right first barrel 52. The outer surface of right first barrel 52 is rigidly attached to right backer plate 53. The front surface or lower edge of right hook plate 55 is rigidly attached to the outer surface of right second barrel 54 so that the lower edge of right hook plate 55 is parallel with the longitudinal axis of right second barrel 54. The rear surface or upper edge of right hook plate 55 is rigidly attached to or integral with the upper angled portion of right hook 58 so that the longitudinal axis of the straight portion of right hook 58 is parallel with the longitudinal axis of right hook plate 55, as depicted. Alternately, right first barrel 52 and right second barrel 54 maybe alternated or swapped from as described above, so that the right first barrel 52 is rigidly attached to or integral with right hook plate 55 and right second barrel 54 is rigidly attached to or integral with right backer plate 53. It does not matter which barrel is attached to which plate, because the plates 53,55 will still be pivotally connected by right hinge pin 56.

Right hook 58 functions as a hook that attaches to a fence 120 by sliding the right hook 58 into an aperture on the fence or a horizontal member on the fence, as a wire. Gravity then holds the hook 58 and the device 5 onto the aperture or horizontal member of the fence. To remove right hook 58 and the device 5 from the fence, right hook 58 is simply lifted up to lift the right hook 58 up and out from the aperture or off of the horizontal member of the fence. Right hook 58 is designed to easily slide into an aperture of a chain-link fence because most baseball fields and softball fields use chain-link fences that run around the baseball or softball field. Thus, this invention 5 is very convenient and easy to bring to a baseball or softball field and set up on the field for use by the players 100. In best mode, right hook 58 is identical to left hook 48.

Therefore, portable batting training device that is reversibly attachable to a fence 5 is easily attached to a fence 120 using left hook assembly 40 and right hook assembly 50. Because of the superior design of this product 5, these two hooks 40,50 all that is needed in order to provide a very strong and stable connection to the fence 120.

Baseball assembly 70 comprises: a baseball or softball 72; a ball retaining cord 74; and a retaining cord hook 76.

Baseball or softball 72 is a spherical object that is hit and caught in a game. Baseball or softball 72 is a baseball or softball in the common definition of the words. In best mode, the exact baseball or softball of the particular league that the players 100 are playing in is purchased from the proper licensed manufacturer. Then, during construction of the device 5, the manufacturer carefully attaches the ball retaining cord 74 to the particular baseball or softball that was purchased. This can be done by any known way that creates a very secure and rigid connection. In best mode, a hole is drilled through the particular baseball or softball, where in the ball retaining cord 74 is inserted therein, and very rigidly and securely secured therein. In best mode, a knot is tied on the end of the ball retaining cord 74 and a very strong epoxy is poured into the drilled hole and saturated into the ball retaining cord 74 and the knot wherein the epoxy hardens and the ball 72 is attached to the ball retaining cord 74 forever. Note that it definitely would be a safety hazard if the baseball or softball 72 came loose from the ball retaining cord 74; therefore, it is crucial that this connection be extremely strong and robust and will never fail.

Ball retaining cord 74 is a length of cordage, rope, or strap. Ball retaining cord 74 has: an upper end, a lower end, and a length. The lower end of ball retaining cord 74 is rigidly attached to baseball or softball 72, as depicted.

Retaining cord hook 76 is a piece of metal or other material that is curved or bent back at an angle for catching hold of or hanging things on. Retaining cord hook 76 is a hook in the common meaning of the word. Retaining cord hook 76 is rigidly attached to the upper end of ball retaining cord 74, as depicted.

Baseball assembly 70 further comprises: two rings or connectors 78. Each ring or connector 78 is a rigid circular member with an inner diameter and an outer diameter. Each ring or connector 78 is a rigid circular loop.

Each ring or connector 78 functions to attach to the retaining cord hook 76 on the ball assembly 70. The retaining cord hook 76 is reversibly attachable to each ring or connector 78. During assembly of the device 5, the first ring or connector 78 is slid over the left side member 20 as the left side member 20 is slid into and installed into the left sleeve 66. The ring or connector 78 then lives on left side member 20 within the center gap of left sleeve 66, as depicted. During assembly of the device 5, the second ring or connector 78 is slid over the right side member 22 as the right side member 22 is slid into and installed into the right sleeve 68. The ring or connector 78 then lives on right side member 22 within the center gap of right sleeve 68, as depicted.

The height of the baseball or softball 72 may be adjusted in the following way. The retaining cord hook 76 is passed through or threaded through one of the ring or connectors 78. Not hooking the retaining cord hook 76 to the ring or connector 78, but simply passing the retaining cord hook 76 through the ring or connector 78 and then pulling the retaining cord hook 76 on up to the net 60 and then attaching the retaining cord hook 76 to one of the apertures on the net 60. There are many apertures on 60. The retaining cord hook 76 is pulled through the ring or connector 78 until the baseball or softball 72 is at the proper height for the batter 100, then the retaining cord hook 76 is latched or hooked onto the appropriate aperture in the net 60 to retain the baseball or softball 72 at this proper height. The baseball or softball 72 may be set at any height by simply hooking the retaining cord hook 76 to the proper aperture that yields the proper height.

In order to use portable batting training device that is reversibly attachable to a fence 5, the following procedure is followed. Portable batting training device that is reversibly attachable to a fence 5 is removed from the carrying case. The collapsible frame 10 is unfolded and erected into the proper rectangular shape. Then a locking pin 32 is used to lock the first rear member 12 to the second rear member 14. Then another locking pin 32 is used to lock the first front member 16 to the second front member 18. Then the erected collapsible frame 10 can be attached to a fence 120 by folding up left hook assembly 40 and folding up right hook assembly 50 and sliding the left hook 48 on an aperture or horizontal member in the fence 120 while also sliding right hook 58 on an aperture or horizontal member in the fence 120 to slide the hooks 48,58 all the way down until they bottom out and are fully attached to the aperture or horizontal member. Then the ball assembly 70 is attached to the proper ring or connector 78, either for a right hand batter or a left-hand batter. At which point in time, portable batting training device that is reversibly attachable to a fence 5 is ready for batting practice by a batter or player 100.

In order to break down and pack up the portable batting training device that is reversibly attachable to a fence 5, the following procedure is followed. The erected collapsible frame 10 is removed from the fence 120 by sliding it upwards until the left hook 48 in the right hook 58 are both free and clear from the aperture or horizontal member in the fence 120. Then the locking pin 32 is removed from first front member 16 and second front member 18. Then the other locking pin 32 is removed from first rear member 12 and second rear member 14. Then the collapsible frame can be rotated and collapsed down into a neat bundle as shown and described above. Then it can be placed in the carrying case for easy transport.

What is claimed:

1. A portable batting training device comprising: a collapsible frame; a left hook assembly; a right hook assembly; a net; and a ball assembly, wherein, said collapsible frame comprises: a first rear member; a second rear member; a first front member; a second front member; a left side member; a right side member; a set of six hinge pins; and a set of two locking pins, wherein, said first rear member is a rigid cylindrical member with: a length, an outer diameter, a left end, a right end, and a longitudinal axis, said first rear member has a left hinge pin hole adjacent to said left end, said first rear member has a right hinge pin hole adjacent to said right end, said first rear member has a locking pin hole in between said left hinge pin hole and said right hinge pin hole, said second rear member is a rigid cylindrical member with: a length, an outer diameter, a left end, a right end, and a longitudinal axis, said second rear member has a right hinge pin hole adjacent to said right end, said second rear member has a left hinge pin hole adjacent to said left end, said second rear member has a locking pin hole in between said left end and said left hinge pin hole, said first front member is a rigid cylindrical member with: a length, an outer diameter, a left end, a right end, and a longitudinal axis, said first front member has a left hinge pin hole adjacent to said left end, said first front member has a right hinge pin hole adjacent to said right end, said first front member has a locking pin hole in between said left hinge pin hole and said right hinge pin hole, said second front member is a rigid cylindrical member with: a length, an outer diameter, a left end, a right end, and a longitudinal axis, said second front member has a right hinge pin hole adjacent to said right end, said second front member has a left hinge pin hole adjacent to said left end, said second front member has a locking pin hole in between said left end and said left hinge pin hole, said left side member is a rigid cylindrical member with: a length, an outer diameter, a rear end, a front end, and a longitudinal axis, said left side member has a rear hinge pin hole adjacent to said rear end, said left side member has a front hinge pin hole adjacent to said front end, said right side member is a rigid cylindrical member with: a length, an outer diameter, a rear end, a front end, and a longitudinal axis, said right side member has a rear hinge pin hole adjacent to said rear end, said right side member has a front hinge pin hole adjacent to said front end, each of said set of six hinge pins is a rigid cylindrical member with: a length, an outside diameter, a first end, a second, and a longitudinal axis, and each of a said set of two locking pins is a rigid cylindrical member with: a length, an outside diameter, a first end, a second, and a longitudinal axis, said net is an assembly of threads, cords, straps, or yarns knotted and twisted into a grid-like structure, said net is a rectangular shaped section of netting with: a width, a length, a thickness, a rear edge, a front edge, a left edge, and a right edge, said net further comprises: a rear sleeve; front sleeve; left sleeve; and a right sleeve, wherein, said rear sleeve is a tubular segment of strong tear-resistant fabric, said rear sleeve has: a length, an inner diameter, an outer diameter, a rear side, a front side, a center, a left end, and a right end, said rear edge of said net is sewn to or otherwise permanently attached to said front side of said rear sleeve, said rear sleeve has a center gap that is a void or notch cut out of said center of said rear sleeve, said front sleeve is a tubular segment of strong tear-resistant fabric, said front sleeve has: a length, an inner diameter, an outer diameter, a rear side, a front side, a center, a left end, and a right end, said front edge of said net is sewn to or otherwise permanently attached to said rear side of said front sleeve, said front sleeve has a center gap that is a void or notch cut out of said center of said front sleeve, said left sleeve is a tubular segment of strong tear-resistant fabric, said left sleeve has: a length, an inner diameter, an outer diameter, a rear side, a front side, a center, a left end, and a right end, said left edge of said net is sewn to or otherwise permanently attached to said right end of said left sleeve, said left sleeve has a center gap that is a void or notch cut out of said center of said left sleeve, said right sleeve is a tubular segment of strong tear-resistant fabric, said right sleeve has: a length, an inner diameter, an outer diameter, a rear side, a front side, a center, a left end, and a right end, said right edge of said net is sewn to or otherwise permanently attached to said left end of said right sleeve, and said right sleeve has a center gap that is a void or notch cut out of said center of said right sleeve, said left hook assembly comprises: a left sleeve mount; a left first barrel; a left backer plate; a left second barrel; a left hook plate; a left hinge pin; and a left hook, wherein, said left sleeve mount is a rigid hollow cylindrical member with open ends, said left sleeve mount has: a rear end, a front end, an inner diameter, an outer diameter, an outer surface, an inner surface, a length, and a longitudinal axis, said left sleeve mount has a hinge pin hole, said left first barrel is a rigid hollow cylindrical member with open ends, said left first barrel has: an inner diameter, an outer diameter, an outer surface, an inner surface, a length, and a longitudinal axis, said left backer plate is a rigid planar member, said left backer plate has: a length, a width, a thickness, a rear surface, a front surface, an upper edge, a lower edge, a left edge, a right edge, and a plane, said left second barrel is a rigid hollow cylindrical member with open ends, said left second barrel has: an inner diameter, an outer diameter, an outer surface, an inner surface, a length, and a longitudinal axis, said left hook plate is a rigid planar member, said left hook plate has: a length, a width, a thickness, a rear surface, a front surface, an upper edge, a lower edge, a left edge, a right edge, a plane, latitudinal axis, and a longitudinal axis, said left hinge pin is a rigid cylindrical member with: a length, an outside diameter, a first end, a second, and a longitudinal axis, said left hook is a piece of material that is curved or bent back at an angle, said left hook has: an upper angled portion, a straight portion, and a lower flared portion, said left sleeve mount is rigidly attached to said left backer plate, said front surface or said upper edge of said left backer plate is rigidly attached to said outer surface of said left first barrel, said front surface or said lower edge of said left hook plate is rigidly attached to said outer surface of said left second barrel, and said rear surface or said upper edge of said left hook plate is rigidly attached to or integral with said upper angled portion of said left hook, said right hook assembly comprises: a right sleeve mount; a right first barrel; a right backer plate; a right second barrel; a right hook plate; a right hinge pin; and a right hook, wherein, said right sleeve mount is a rigid hollow cylindrical member with open ends, said right sleeve mount has: a rear end, a front end, an inner diameter, an outer diameter, an outer surface, an inner surface, a length, and a longitudinal axis, said right sleeve mount has a hinge pin hole, said right first barrel is a rigid hollow cylindrical member with open ends, said right first barrel has: an inner diameter, an outer diameter, an outer surface, an inner surface, a length, and a longitudinal axis, said right backer plate is a rigid planar member, said right backer plate has: a length, a width, a thickness, a rear surface, a front surface, an upper edge, a lower edge, a left edge, and a right edge, said right second barrel is a rigid hollow cylindrical member with open ends, said right second barrel has: an inner diameter, an outer diameter, an outer surface, an inner surface, a length, and a longitudinal axis, said right hook plate is a rigid planar member, said right hook plate has: a length, a width, a thickness, a rear surface, a front surface, an upper edge, a lower edge, a left edge, a right edge, and a longitudinal axis, said right hinge pin is a rigid cylindrical member with: a length, an outside diameter, a first end, a second, and a longitudinal axis, said right hook is a piece of material that is curved or bent back at an angle, said right hook has: an upper angled portion, a straight portion, and a lower flared portion, said right sleeve mount is rigidly attached to said right backer plate, said front surface or said upper edge of said right backer plate is rigidly attached to said outer surface of said right first barrel, said front surface or said lower edge of said right hook plate is rigidly attached to said outer surface of said right second barrel, and said rear surface or said upper edge of said right hook plate is rigidly attached to or integral with said upper angled portion of said right hook, said first rear member is inserted into said rear sleeve, said second rear member is inserted into said rear sleeve, said first front member is inserted into said front sleeve, said second front member is inserted into said front sleeve, said left side member is inserted into said left sleeve, said right side member is inserted into said right sleeve, said first rear member is pivotally attached to said second rear member wherein said right hinge pin hole on said first rear member is aligned with said left hinge pin hole on said second rear member and then one of said set of six hinge pins is installed therein, said first front member is pivotally attached to said second front member wherein said right hinge pin hole on said first front member is aligned with said left hinge pin hole on said second front member and then one of said set of six hinge pins is installed therein, said first rear member is pivotally attached to said left side member wherein said rear end of said left side member is first inserted into said left sleeve mount, said left hinge pin hole on said first rear member is aligned with said rear hinge pin hole on said left side member and then one of said set of six hinge pins is installed through said hinge pin hole of said left side member, said hinge pin hole of said left sleeve mount, and said hinge pin hole of said first rear member, said second rear member is pivotally attached to said right side member wherein said rear end of said right side member is first inserted into right sleeve mount, said right hinge pin hole on said second rear member is aligned with said rear hinge pin hole on said right side member and then one of said set of six hinge pins is installed through said hinge pin hole of right side member, said hinge pin hole of right sleeve mount, and said hinge pin hole of said second rear member, said first front member is pivotally attached to said left side member wherein said left hinge pin hole on said first front member is aligned with said front hinge pin hole on said left side member and then one of said set of six hinge pins is installed therein, said second front member is pivotally attached to said right side member wherein said right hinge pin hole on said second front member is aligned with said front hinge pin hole on said right side member and then one of said set of six hinge pins is installed therein, one of said set of two locking pins is reversibly attachable within said locking pin hole in said first rear member and said locking pin hole in said second rear member, and one of said set of two locking pins is reversibly attachable within said locking pin hole in said first front member and said locking pin hole in said second front member.

2. A portable batting training device comprising: a collapsible frame; a left hook assembly; a right hook assembly; a net; and a ball assembly, wherein, said collapsible frame comprises: a first rear member; a second rear member; a first front member; a second front member; a left side member; a right side member; a set of six hinge pins; and a set of two locking pins, wherein, said first rear member is a rigid cylindrical member with: a length, an outer diameter, a left end, a right end, and a longitudinal axis, said first rear member has a left hinge pin hole adjacent to said left end, said first rear member has a right hinge pin hole adjacent to said right end, said first rear member has a locking pin hole in between said left hinge pin hole and said right hinge pin hole, said second rear member is a rigid cylindrical member with: a length, an outer diameter, a left end, a right end, and a longitudinal axis, said second rear member has a right hinge pin hole adjacent to said right end, said second rear member has a left hinge pin hole adjacent to said left end, said second rear member has a locking pin hole in between said left end and said left hinge pin hole, said first front member is a rigid cylindrical member with: a length, an outer diameter, a left end, a right end, and a longitudinal axis, said first front member has a left hinge pin hole adjacent to said left end, said first front member has a right hinge pin hole adjacent to said right end, said first front member has a locking pin hole in between said left hinge pin hole and said right hinge pin hole, said second front member is a rigid cylindrical member with: a length, an outer diameter, a left end, a right end, and a longitudinal axis, said second front member has a right hinge pin hole adjacent to said right end, said second front member has a left hinge pin hole adjacent to said left end, said second front member has a locking pin hole in between said left end and said left hinge pin hole, said left side member is a rigid cylindrical member with: a length, an outer diameter, a rear end, a front end, and a longitudinal axis, said left side member has a rear hinge pin hole adjacent to said rear end, said left side member has a front hinge pin hole adjacent to said front end, said right side member is a rigid cylindrical member with: a length, an outer diameter, a rear end, a front end, and a longitudinal axis, said right side member has a rear hinge pin hole adjacent to said rear end, said right side member has a front hinge pin hole adjacent to said front end, each of said set of six hinge pins is a rigid cylindrical member with: a length, an outside diameter, a first end, a second, and a longitudinal axis, and each of a said set of two locking pins is a rigid cylindrical member with: a length, an outside diameter, a first end, a second, and a longitudinal axis, said net is an assembly of threads, cords, straps, or yarns knotted and twisted into a grid-like structure, said net is a rectangular shaped section of netting with: a width, a length, a thickness, a rear edge, a front edge, a left edge, and a right edge, said net further comprises: a rear sleeve; front sleeve; left sleeve; and a right sleeve, wherein, said rear sleeve is a tubular segment of strong tear-resistant fabric, said rear sleeve has: a length, an inner diameter, an outer diameter, a rear side, a front side, a center, a left end, and a right end, said rear edge of said net is sewn to or otherwise permanently attached to said front side of said rear sleeve, said rear sleeve has a center gap that is a void or notch cut out of said center of said rear sleeve, said front sleeve is a tubular segment of strong tear-resistant fabric, said front sleeve has: a length, an inner diameter, an outer diameter, a rear side, a front side, a center, a left end, and a right end, said front edge of said net is sewn to or otherwise permanently attached to said rear side of said front sleeve, said front sleeve has a center gap that is a void or notch cut out of said center of said front sleeve, said left sleeve is a tubular segment of strong tear-resistant fabric, said left sleeve has: a length, an inner diameter, an outer diameter, a rear side, a front side, a center, a left end, and a right end, said left edge of said net is sewn to or otherwise permanently attached to said right end of said left sleeve, said left sleeve has a center gap that is a void or notch cut out of said center of said left sleeve, said right sleeve is a tubular segment of strong tear-resistant fabric, said right sleeve has: a length, an inner diameter, an outer diameter, a rear side, a front side, a center, a left end, and a right end, said right edge of said net is sewn to or otherwise permanently attached to said left end of said right sleeve, and said right sleeve has a center gap that is a void or notch cut out of said center of said right sleeve, said left hook assembly comprises: a left sleeve mount; a left first barrel; a left backer plate; a left second barrel; a left hook plate; a left hinge pin; and a left hook, wherein, said left sleeve mount is a rigid hollow cylindrical member with open ends, said left sleeve mount has: a rear end, a front end, an inner diameter, an outer diameter, an outer surface, an inner surface, a length, and a longitudinal axis, said left sleeve mount has a hinge pin hole, said left first barrel is a rigid hollow cylindrical member with open ends, said left first barrel has: an inner diameter, an outer diameter, an outer surface, an inner surface, a length, and a longitudinal axis, said left backer plate is a rigid planar member, said left backer plate has: a length, a width, a thickness, a rear surface, a front surface, an upper edge, a lower edge, a left edge, a right edge, and a plane, said left second barrel is a rigid hollow cylindrical member with open ends, said left second barrel has: an inner diameter, an outer diameter, an outer surface, an inner surface, a length, and a longitudinal axis, said left hook plate is a rigid planar member, said left hook plate has: a length, a width, a thickness, a rear surface, a front surface, an upper edge, a lower edge, a left edge, a right edge, a plane, latitudinal axis, and a longitudinal axis, said left hinge pin is a rigid cylindrical member with: a length, an outside diameter, a first end, a second, and a longitudinal axis, said left hook is a piece of material that is curved or bent back at an angle, said left hook has: an upper angled portion, a straight portion, and a lower flared portion, said left sleeve mount is rigidly attached to said left backer plate, said front surface or said upper edge of said left backer plate is rigidly attached to said outer surface of said left second barrel, said front surface or said lower edge of said left hook plate is rigidly attached to said outer surface of said left first barrel, and said rear surface or said upper edge of said left hook plate is rigidly attached to or integral with said upper angled portion of said left hook, said right hook assembly comprises: a right sleeve mount; a right first barrel; a right backer plate; a right second barrel; a right hook plate; a right hinge pin; and a right hook, wherein, said right sleeve mount is a rigid hollow cylindrical member with open ends, said right sleeve mount has: a rear end, a front end, an inner diameter, an outer diameter, an outer surface, an inner surface, a length, and a longitudinal axis, said right sleeve mount has a hinge pin hole, said right first barrel is a rigid hollow cylindrical member with open ends, said right first barrel has: an inner diameter, an outer diameter, an outer surface, an inner surface, a length, and a longitudinal axis, said right backer plate is a rigid planar member, said right backer plate has: a length, a width, a thickness, a rear surface, a front surface, an upper edge, a lower edge, a left edge, and a right edge, said right second barrel is a rigid hollow cylindrical member with open ends, said right second barrel has: an inner diameter, an outer diameter, an outer surface, an inner surface, a length, and a longitudinal axis, said right hook plate is a rigid planar member, said right hook plate has: a length, a width, a thickness, a rear surface, a front surface, an upper edge, a lower edge, a left edge, a right edge, and a longitudinal axis, said right hinge pin is a rigid cylindrical member with: a length, an outside diameter, a first end, a second, and a longitudinal axis, said right hook is a piece of material that is curved or bent back at an angle, said right hook has: an upper angled portion, a straight portion, and a lower flared portion, said right sleeve mount is rigidly attached to said right backer plate, said front surface or said upper edge of said right backer plate is rigidly attached to said outer surface of said right second barrel, said front surface or said lower edge of said right hook plate is rigidly attached to said outer surface of said right first barrel, and said rear surface or said upper edge of said right hook plate is rigidly attached to or integral with said upper angled portion of said right hook, said first rear member is inserted into said rear sleeve, said second rear member is inserted into said rear sleeve, said first front member is inserted into said front sleeve, said second front member is inserted into said front sleeve, said left side member is inserted into said left sleeve, said right side member is inserted into said right sleeve, said first rear member is pivotally attached to said second rear member wherein said right hinge pin hole on said first rear member is aligned with said left hinge pin hole on said second rear member and then one of said set of six hinge pins is installed therein, said first front member is pivotally attached to said second front member wherein said right hinge pin hole on said first front member is aligned with said left hinge pin hole on said second front member and then one of said set of six hinge pins is installed therein, said first rear member is pivotally attached to said left side member wherein said rear end of said left side member is first inserted into said left sleeve mount, said left hinge pin hole on said first rear member is aligned with said rear hinge pin hole on said left side member and then one of said set of six hinge pins is installed through said hinge pin hole of said left side member, said hinge pin hole of said left sleeve mount, and said hinge pin hole of said first rear member, said second rear member is pivotally attached to said right side member wherein said rear end of said right side member is first inserted into right sleeve mount, said right hinge pin hole on said second rear member is aligned with said rear hinge pin hole on said right side member and then one of said set of six hinge pins is installed through said hinge pin hole of right side member, said hinge pin hole of right sleeve mount, and said hinge pin hole of said second rear member, said first front member is pivotally attached to said left side member wherein said left hinge pin hole on said first front member is aligned with said front hinge pin hole on said left side member and then one of said set of six hinge pins is installed therein, said second front member is pivotally attached to said right side member wherein said right hinge pin hole on said second front member is aligned with said front hinge pin hole on said right side member and then one of said set of six hinge pins is installed therein, one of said set of two locking pins is reversibly attachable within said locking pin hole in said first rear member and said locking pin hole in said second rear member, and one of said set of two locking pins is reversibly attachable within said locking pin hole in said first front member and said locking pin hole in said second front member.

* * * * *